US006209303B1

(12) United States Patent
Stahlecker

(10) Patent No.: US 6,209,303 B1
(45) Date of Patent: Apr. 3, 2001

(54) ARRANGEMENT AND METHOD FOR SPINNING A YARN

(75) Inventor: Hans Stahlecker, Suessen (DE)

(73) Assignees: Fritz Stahlecker, Bad Uberkingen (DE); Hans Stahlecker, Süssen (DE)

( * ) Notice: Subject to any disclaimer, the term of this patent is extended or adjusted under 35 U.S.C. 154(b) by 0 days.

(21) Appl. No.: 09/471,268

(22) Filed: Dec. 23, 1999

(30) Foreign Application Priority Data

Dec. 24, 1998 (DE) ..... 198 60 201

(51) Int. Cl.[7] ..... D01H 11/00

(52) U.S. Cl. ..... 57/304; 57/315; 57/328; 19/150; 19/246

(58) Field of Search ..... 19/150, 236–250, 19/252, 263, 286–288, 304–308; 57/304, 315, 308, 328, 333

(56) References Cited

U.S. PATENT DOCUMENTS 3,176,351 * 4/1965 Keen ..... 19/236
3,739,564 * 6/1973 King ..... 57/315
4,953,349 * 9/1990 Fehrer ..... 57/315
4,976,096 * 12/1990 Sawhney et al. ..... 19/244
5,090,192 * 2/1992 Stahlecker ..... 57/328
5,531,063 * 7/1996 Sawhney et al. ..... 19/244
5,600,872 * 2/1997 Artzt et al. ..... 19/244
6,052,872 * 4/2000 Lang et al. ..... 19/288

* cited by examiner

*Primary Examiner*—John J. Calvert
*Assistant Examiner*—Gary L. Welch
(74) *Attorney, Agent, or Firm*—Evenson, McKeown, Edwards & Lenahan, P.L.L.C.

(57) ABSTRACT

An arrangement and method for spinning a yarn from a plurality of yarn components includes a drafting arrangement, a condensing zone arranged downstream thereof and also a ring spindle which twists all yarn components jointly. The condensing zone has a stationary sliding surface for a perforated transport belt which transports the yarn components through said condensing zone. At least one suction slit is located on the sliding surface, which suction slit extends essentially in a transport direction of the yarn components. The condensing zone is defined on its exit side by a nipping roller, which presses the yarn components and the transport belt onto the sliding surface. The at least one suction slit extends to the nipping point. The yarn components may be a sliver or roving and a core yarn, or two slivers or rovings, which, with or without any core yarn, together form the subsequent yarn.

14 Claims, 6 Drawing Sheets

ARRANGEMENT AND METHOD FOR SPINNING A YARN

BACKGROUND AND SUMMARY OF THE INVENTION

This application claims the priority of German application 198 60 201.4, filed Dec. 24, 1998, the disclosure of which is expressly incorporated by reference herein.

The present invention relates to an arrangement for the spinning of yarn or thread from a plurality of yarn components, comprising

- a drafting arrangement comprising a front roller pair feeding at least two yarn components,
- a condensing zone downstream thereof through which all yarn components travel,
- a stationary sliding surface provided in the condensing zone, which sliding surface comprises at least one suction slit which extends essentially in transport direction of the yarn components,
- a perforated transport belt which transports the yarn components over the sliding surface,
- a nipping roller defining the condensing zone on an exiting side by forming a nipping point,
- and a ring spindle downstream thereof which twists all yarn components jointly.

An arrangement of this type is prior art in the international patent application WO 98/39505. Two fiber rovings are drafted in the drafting arrangement at close proximity to one another and thereafter condensed downstream of the drafting arrangement in the condensing zone. Subsequently, the drafted and condensed rovings can be fed to different ring spindles or to one common ring spindle. In the latter case, a so-called mock twist occurs. The transporting belt comprises two rows of holes, of which each one guides a fiber roving through the condensing zone. The end of the condensing zone is defined by a delivery roller pair, the transport belt being looped around one of the rollers.

A previously drafted but still twist-free fiber strand is bundled in the condensing zone, so that when it exits out of the condensing zone, that is at the last nipping point, a spinning triangle does not occur when the yarn components are subsequently twisted to form a yarn. The yarn is then less hairy and has an increased evenness and a greater tensile strength. As a result of a delivery roller pair being arranged downstream of the condensing zone, the suctioning of the yarn components to be condensed ends at a significant distance from the nipping point of the delivery roller pair. The condensed yarn components have thus disadvantageously the opportunity to expand again. Thus the actual aim of the condensing zone is only partially achieved.

It is an object of the invention to design the condensing zone arranged downstream of the front roller pair of the drafting arrangement, in particular when a plurality of yarn components are present, in such a way that the condensed yarn components retain their state until they reach the nipping point.

This object has been achieved in accordance with the present invention in that the nipping roller presses the yarn components and the transport belt to the sliding surface and in that the at least one suction slit extends up to the nipping point.

The nipping roller defining the condensing zone on its exit side no longer forms the nipping point with another roller, but rather with a stationary sliding surface, over which the transport belt is slidingly guided. The at least one suction slit can thus be extended to the end of the condensing zone, so that the condensing effect is not lost before the yarns reach the nipping point. The condensed effect is particularly homogenous when the transport belt is designed as a close-meshed woven belt.

The yarn components which are twisted together to form a yarn at the ring spindle can be of varying kinds.

For example, as in the above mentioned prior art, two fiber rovings can be guided each over one suction slit and are each condensed in the condensing zone before they are united at a yarn guide downstream of the nipping point. Slivers or rovings may be involved. Additionally, a core yarn can be added, which is fed by means of a feed roller arranged at the front roller pair of the drafting arrangement. Alternatively it is possible to guide only one sliver or roving through the condensing zone and to unite it with one single core yarn.

The yarn to be twisted at the ring spindle can thus either be created from two slivers or rovings, each with or without a core yarn, or be formed from one sliver or roving and a core yarn.

Other objects, advantages and novel features of the present invention will become apparent from the following detailed description of the invention when considered in conjunction with the accompanying drawings.

DETAILED DESCRIPTION OF THE DRAWINGS

Figure 1:
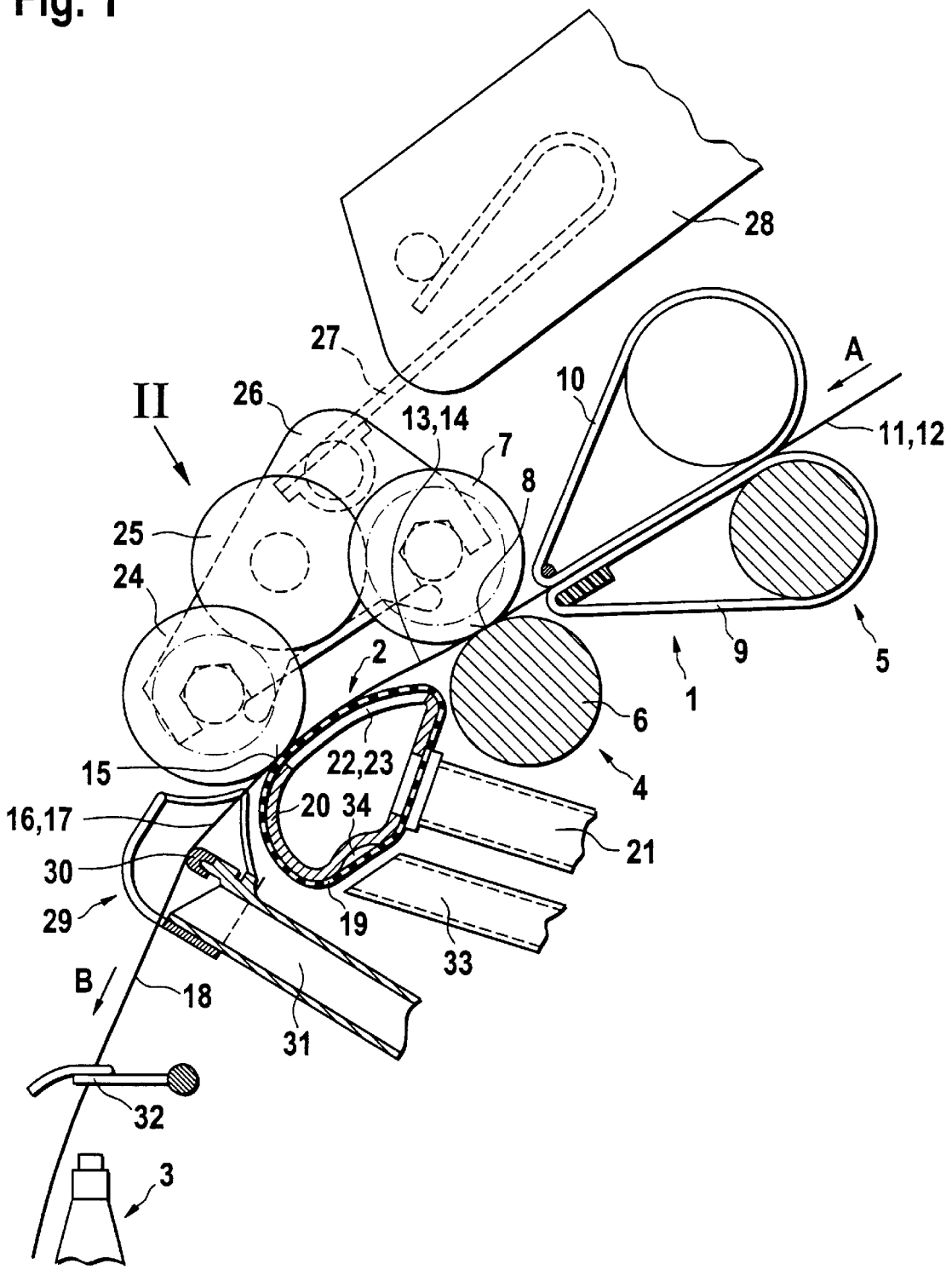
FIG. 1 is a part sectional side schematic view of an arrangement in an area of a condensing zone, constructed according to preferred embodiments of the present invention.
Figure 2:
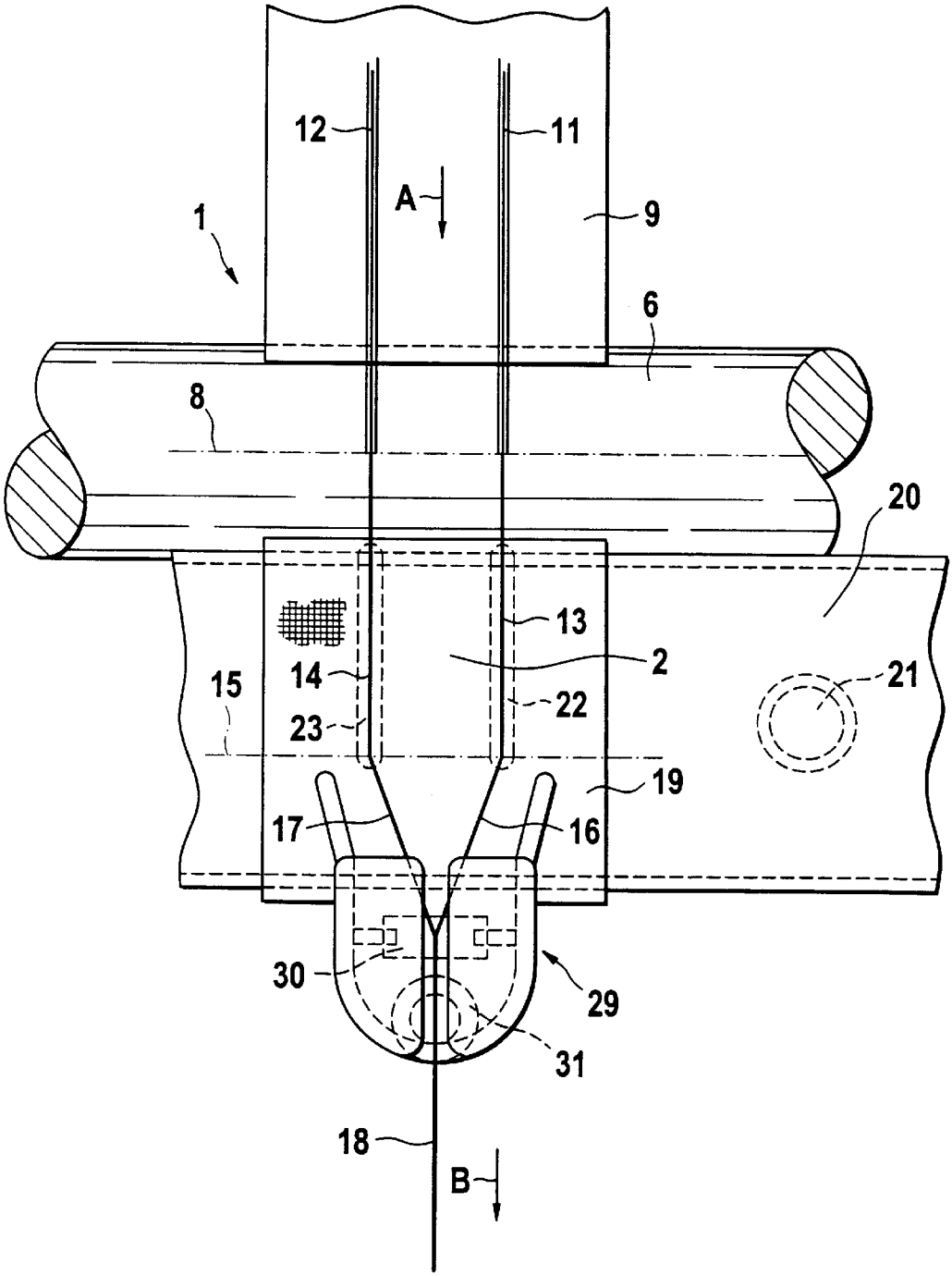
FIG. 2 is a view in the direction of the arrow II of FIG. 1, showing an arrangement whereby to facilitate the drawing illustration some components have been omitted, showing a yarn formed from two slivers or rovings.

The arrangement shown in FIGS. 1 and 2 comprises a drafting arrangement 1, a condensing zone 2 arranged downstream thereof as well as a ring spindle 3. These parts are important components of a spinning station, of which a plurality are arranged adjacently in a row in an operating machine.

Of the drafting arrangement 1, only the front roller pair 4 and the apron roller pair 5 arranged upstream thereof are shown. The front roller pair 4 comprises a front bottom cylinder 6 extending in machine longitudinal direction, to which one front top roller 7 is arranged per spinning station. In a way not shown, two front top rollers 7 of adjacent spinning stations can be joined together to form top roller twins. The front bottom cylinder 6 forms a front nipping line 8 together with the respective front top roller 7. Between the apron roller pair 5 and the front roller pair 4, the fiber material to be drafted is fed by bottom aprons 9 and top aprons 10 in a known way.

In the embodiment shown in FIGS. 1 and 2, two slivers or rovings 11 and 12 are fed to the drafting arrangement 1 in transport direction A, the slivers or rovings 11 and 12 travelling closely adjacent to one another through the drafting arrangement 1. Thus four slivers or rovings altogether are arranged at each of the top roller twins.

At the front roller pair 4, the slivers or rovings 11,12 are drafted to as yet untwisted fiber strands 13 and 14, which then travel through the condensing zone 2 to a nipping point 15. The nipping point 15 defines the condensing zone 2 at its exit side. From the point of the nipping point 15 onwards, two condensed yarn components 16 and 17 per drafting arrangement 1 are present, which are subsequently united to a single yarn 18. The yarn 18 is fed in the delivery direction B to the ring spindle 3.

A perforated transport belt 19 serves for the transport of the drafted, but as yet twist-free fiber strands 13 and 14 through the condensing zone 2, which transport belt 19 consists of a very thin woven belt and which is very close-meshed. The woven belt consists preferably of plastic fibers, so that it can be joined to form an endless transport belt 19 and its lateral edges can be welded. The transport belt 19 transports the fiber strands 13 and 14 over an exterior sliding surface of a hollow profile 20, which is designed as a suction device and which extends over a plurality, for example six or eight, spinning stations. A suction source 21 is preferably arranged at each hollow profile 20, so that per machine section there is one suction source 21.

Two suction slits 22 and 23, parallel to one another, are arranged on the sliding surface of the hollow profile 20, one of the suction slits 22 and 23 in each case being arranged at a fiber strand 13 or 14. The suction slits 22 and 23 are significantly wider than the bundled yarn components 16 and 17. They extend essentially in transport direction A, begin shortly after the front roller pair 4 and extend up to the nipping point 15. The latter is particularly important, so that the condensing effect is not lost before the yarn reaches the nipping point 15.

The nipping point 15 is formed by means of a nipping roller 24, which presses the condensed yarn components 16 and 17 as well as the transport belt 19 against the sliding surface of the hollow profile 20. The nipping roller 24 is driven by the front top roller 7 by means of a transfer roller 25, so that the peripheral speeds at the front top roller 7 and at the nipping roller 24 are essentially the same. The peripheral speed at the nipping roller 24 should only be that much higher as to allow a slight tension draft to be exerted on the fiber strands 13 and 14.

The front top rollers 7 as well as the nipping rollers 24 of each of the top roller twins are arranged in a rocker 26, which is supported in turn in the top arm 28 of the drafting arrangement 1 by means of a loading spring 27.

The condensed yarn components 16 and 17 are united at a yarn guide 29 arranged downstream of the nipping point 15. At the point of union a wear-resistant ceramic insert 30 is provided, which, however, permits the spinning twist through to the nipping point 15. The yarn guide 29 is connected to a suction tube 31 in a known way. From here the united yarn components 16 and 17 are guided as a single yarn 18 via a balloon yarn guide 32 to the ring spindle 3.

In the present case, a so-called spin-twist or also mock twist subsequently arises from the two fiber strands or rovings 11 and 12.

A cleaning tube 33 can be arranged at the transport belt 19 on the side facing away from the condensing zone 2, which cleaning tube frees the transport belt 19 from any adhering fiber fly. A recess 34 of the hollow profile 20 is arranged at the cleaning tube 33, so that the cleaning is more easily facilitated.

Figure 3:
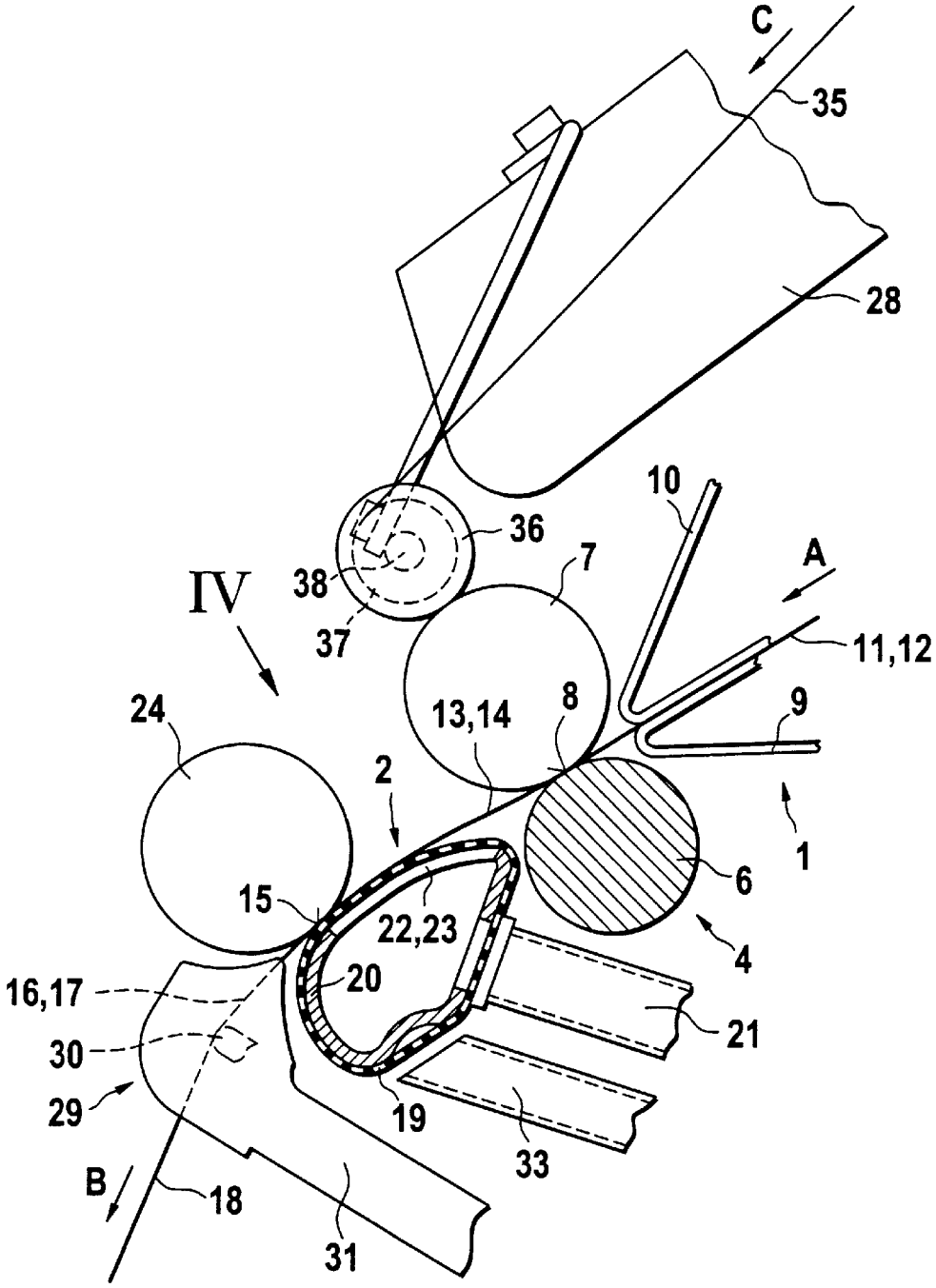
FIG. 3 is a view similar to FIG. 1, showing an arrangement whereby a core yarn has been added to the slivers or rovings.
Figure 4:
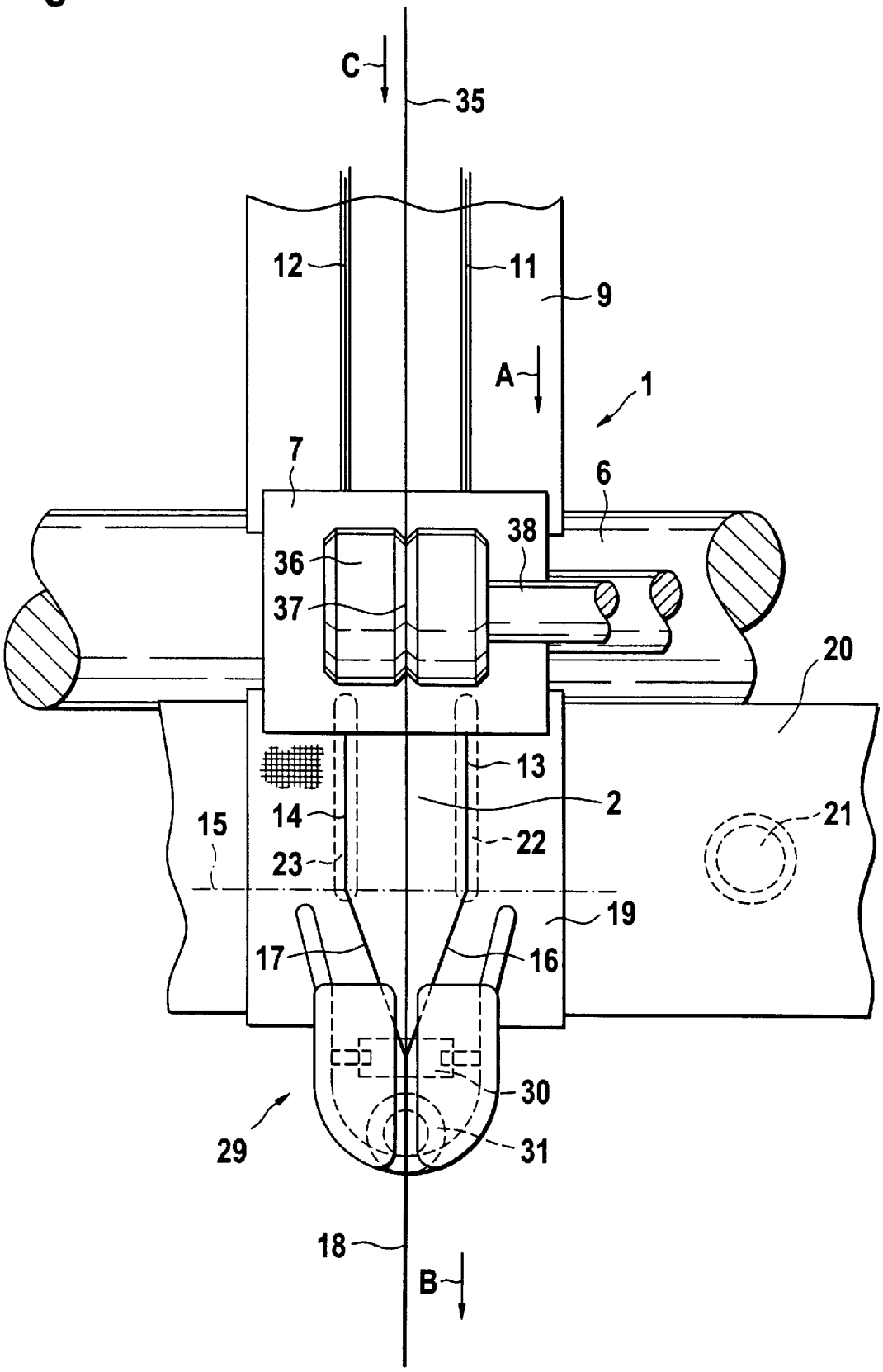
FIG. 4 is a view in the direction of the arrow IV of FIG. 3, whereby to facilitate the drawing illustration some components have again been omitted.

The embodiment of the present invention according to FIGS. 3 and 4 differs from the embodiment of the present invention shown in FIGS. 1 and 2 essentially in that a core yarn 35 is added in feed direction C in the center between the fiber slivers or rovings 11 and 12. The core yarn 35 is fed to the drafting arrangement 1 at the front roller pair 4. A feed roller 36 is provided for this purpose, which comprises a peripheral groove 37 for the core yarn 35, by means of which groove 37 the core yarn 35 is centrically positioned. Two feed rollers 36 are connected with one another by means of an axle 38 to form twin rollers.

As the core yarn 35 consists usually of endless filaments, the core yarn 35 does not really need to be condensed. For this reason it is provided that the core yarn 35 travels centrically between the two suction slits 22 and 23 through the condensing zone 2 and is only then united with the condensed yarn components 16 and 17 downstream of the nipping point 15. The point of union here lies at the yarn guide 29.

Figure 5:
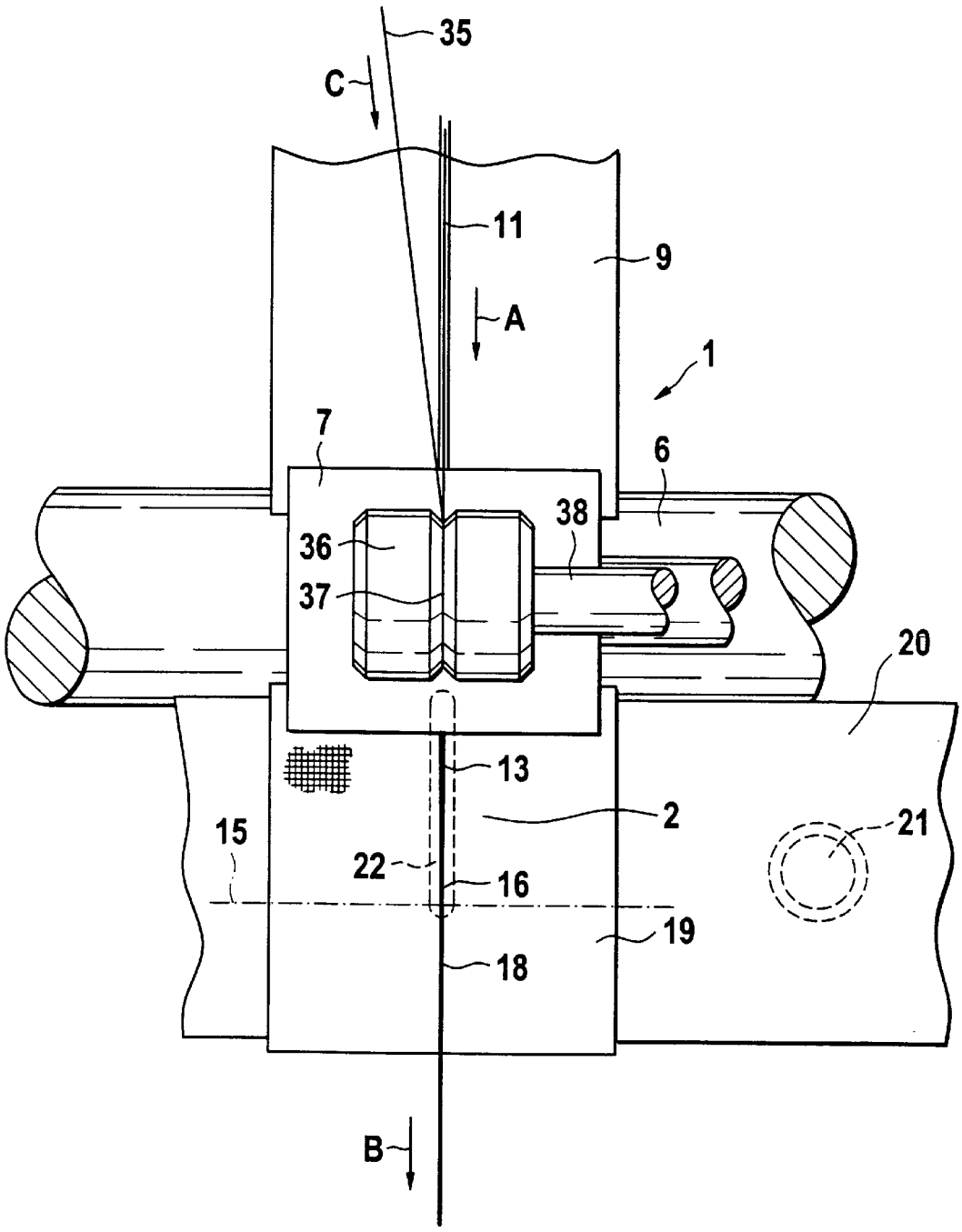
FIG. 5 is a view similar to FIG. 4 showing another embodiment, in which a sliver or roving as well as a core yarn have been united to form one yarn.

The present invention includes also an embodiment according to FIG. 5, in which only one fiber sliver or roving 11 is transported in transport direction A by the drafting arrangement 1, whereby a single core yarn 35 is added to this sliver or roving 11 which yarn 35 is fed in feed direction C. The condensing zone 2 comprises in this case only one suction slit 22. The core yarn 35 is here also guided by means of the peripheral groove 37 of a feed roller 36 and is united at the front nipping line 8 of the front roller pair 4 with the sliver or roving 11. Both yarn components, namely the drafted, still twist-free fiber strand 13 as well as the core yarn 35 are guided in this embodiment of the present invention over the suction slit 22 and are pressed at the end of the condensing zone 2 by the nipping roller 24 to the sliding surface of the hollow profile 20. The arising yarn 18 is in this case a normal core yarn, which is, however, less hairy than standard core yarns.

Figure 5A:
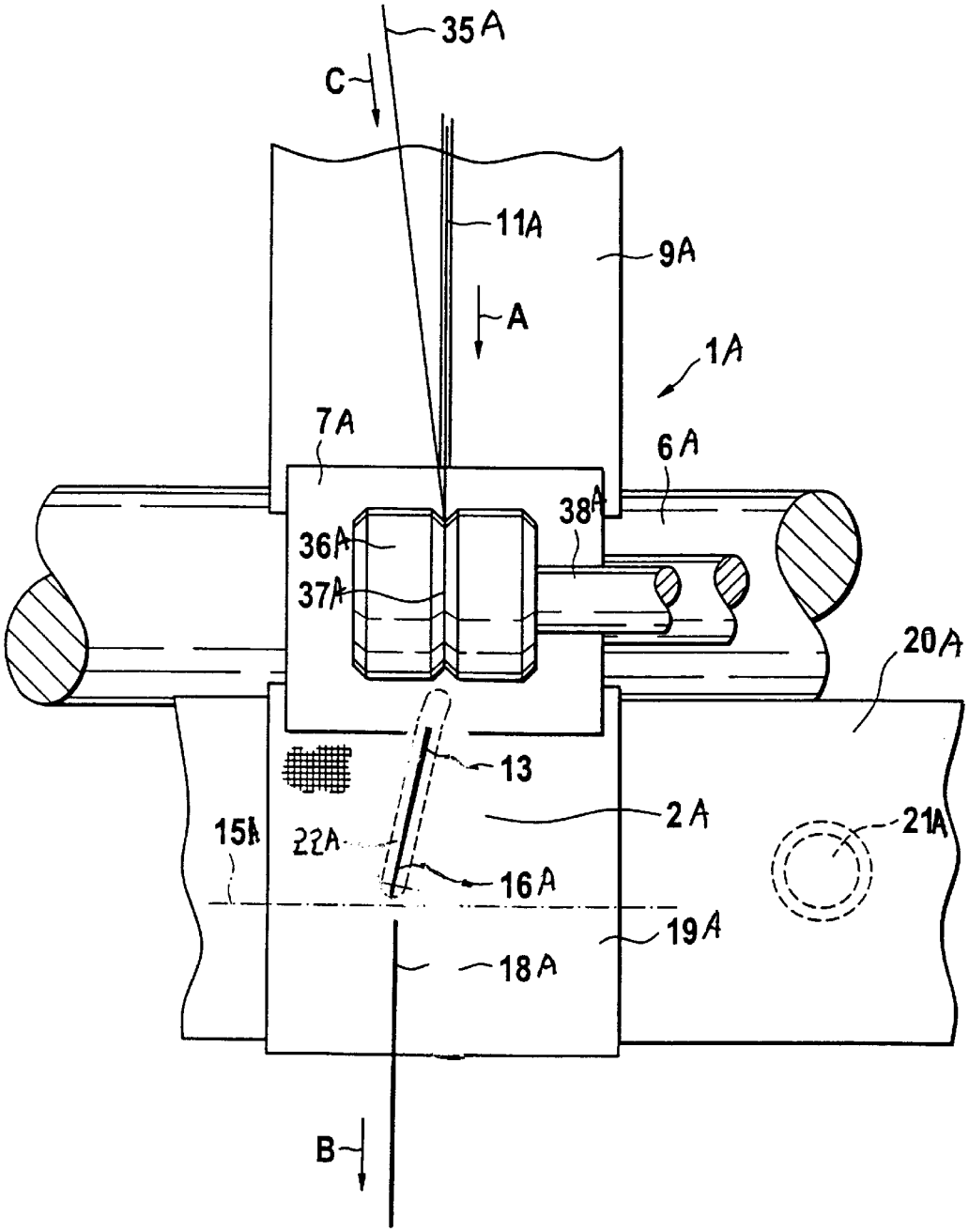
FIG. 5A is a view similar to FIG. 5 showing another embodiment, similar to FIG. 5, but with the suction slit of the condensing zone angularly inclined with respect to the sliver travel direction from the drafting arrangement.

FIG. 5A shows another preferred embodiment which is similar to FIG. 5, except for the angular inclination of the slit 22A with respect to the travel direction of the sliver exiting the drafting arrangement. In FIG. 5A, the same reference numerals as in FIG. 5, with the suffix "A" are used to indicate corresponding features of FIGS. 5 and 5A. Other than the angularly inclined orientation of the suction slit 22, the description of correspondingly numbered parts from FIG. 5 apply.

Embodiments are also contemplated which are similar to the above described embodiments of FIGS. 1–4, but with the suction slits of the condensing zone angularly inclined as depicted for the embodiment of FIG. 5A. In these embodiments, the angular inclination of the two slots would be toward a central location leading to the yarn guide 29.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An arrangement for the spinning of yarn from a plurality of yarn components, comprising:

a drafting arrangement comprising a front roller pair feeding at least two yarn components which each are formed from one of a fiber sliver and a roving, a condensing zone downstream of the front roller pair through which all yarn components travel, a stationary sliding surface provided in the condensing zone, which sliding surface comprises at least one suction slit which extends essentially in transport direction of the yarn components, a perforated transport belt which transports the yarn components over the sliding surface, a nipping roller defining the condensing zone on an exiting side by forming a nipping point, and a subsequent ring spindle which twists all yarn components jointly, wherein the nipping roller presses the yarn components and the transport belt to the sliding surface, and wherein the at least one suction slit extends to the nipping point.

2. An arrangement according to claim 1, wherein the at least one suction slit includes two parallel to one another extending suction slits which are provided for two yarn components formed from the one of drafted fiber slivers and rovings, and wherein between the nipping point and the ring spindle a yarn guide is provided which unites both yarn components.

3. An arrangement according to claim 2, wherein at least one of the yarn components is a core yarn which is fed at the front roller pair of the drafting arrangement, to which core yarn is added a yarn component in the form of the one of a drafted sliver and a roving, which unites with the core yarn at the latest downstream of the condensing zone.

4. An arrangement according to claim 3, wherein a feed roller which positions the core yarn to the one of the sliver and roving is arranged to feed the core yarn.

5. An arrangement according to claim 1, wherein at least one of the yarn components is a core yarn which is fed at the front roller pair of the drafting arrangement, to which core yarn is added a yarn component in the form of the one of a drafted sliver and a roving, which unites with the core yarn at the latest downstream of the condensing zone.

6. An arrangement according to claim 5, wherein a feed roller is provided which positions and feeds the core yarn to the one of a sliver and a roving.

7. An arrangement according to claim 1, wherein the at least one suction slit is angularly inclined with respect to a travel direction of the respective yarn component from the drafting arrangement.

8. A process of making yarn from a plurality of yarn components, comprising:

drafting at least one yarn component in a drafting arrangement having a front roller pair feeding at least two yarn components which each are formed from one of a fiber sliver and a roving, condensing the at least one yarn component in a condensing zone by transporting the at least one yarn component on a perforated transport belt movable over a stationary sliding surface which has at least one suction slit extending essentially in a transport direction of the yarn components, nipping the yarn components at a nipping point with a nipping roller at an exit end of the condensing zone, said nipping roller pressing the yarn components and the transport belt against the sliding surface, said at least one suction slit extending to the nipping points, wherein said condensing includes flowing suction air through the conveyor belt via the at least one suction slit up to the nipping points, and subsequently ring spinning all yarn components jointly at a ring spindle.

9. A process according to claim 8, wherein the at least one suction slit includes two parallel to one another extending suction slits which are provided for two yarn components formed from respective ones of drafted fiber slivers and rovings, and wherein between the nipping point and the ring spindle a yarn guide is provided which unites both yarn components.

10. A process according to claim 9, wherein at least one of the yarn components is a core yarn which is fed at the front roller pair of the drafting arrangement, to which core yarn is added a yarn component in the form of the one of a drafted sliver and a roving, which unites with the core yarn at the latest downstream of the condensing zone.

11. A process according to claim 10, wherein a feed roller which positions the core yarn to the one of a sliver and a roving is arranged to feed the core yarn.

12. A process according to claim 8, wherein at least one of the yarn components is a core yarn which is fed at the front roller pair of the drafting arrangement, to which core yarn is added a yarn component in the form of the one of a drafted sliver and a roving, which unites with the core yarn at the latest downstream of the condensing zone.

13. A process according to claim 12, wherein a feed roller which positions the core yarn to the one of a sliver and a roving is arranged to feed the core yarn.

14. A process according to claim 8, wherein the at least one suction slit is angularly inclined with respect to a travel direction of the respective yarn component from the drafting arrangement.

* * * * *